US007604044B2

(12) United States Patent
Kawakubo et al.

(10) Patent No.: US 7,604,044 B2
(45) Date of Patent: Oct. 20, 2009

(54) HEAT EXCHANGER

(75) Inventors: Masaaki Kawakubo, Kariya (JP); Norihide Kawachi, Kariya (JP); Ken Muto, Toyota (JP); Ken Yamamoto, Obu (JP); Etsuo Hasegawa, Nagoya (JP); Yoshiki Katoh, Kariya (JP)

(73) Assignee: Denso Corporation, Kariya (JP)

( * ) Notice: Subject to any disclaimer, the term of this patent is extended or adjusted under 35 U.S.C. 154(b) by 74 days.

(21) Appl. No.: 11/348,435

(22) Filed: Feb. 6, 2006

(65) Prior Publication Data

US 2006/0151159 A1 Jul. 13, 2006

Related U.S. Application Data

(62) Division of application No. 10/361,657, filed on Feb. 10, 2003, now Pat. No. 7,044,208.

(30) Foreign Application Priority Data

Feb. 19, 2002 (JP) ..... 2002-041332
Oct. 30, 2002 (JP) ..... 2002-316437

(51) Int. Cl.
*F28F 9/02* (2006.01)

(52) U.S. Cl. ..... 165/175; 165/178

(58) Field of Classification Search ..... 165/173, 165/175, 178, 174
See application file for complete search history.

(56) References Cited

U.S. PATENT DOCUMENTS 3,153,447 A 10/1964 Yoder
3,411,196 A 11/1968 Zehnder
3,908,758 A 9/1975 Armonies et al.
3,920,069 A 11/1975 Mosier
4,917,180 A 4/1990 Wolf et al.

(Continued)

FOREIGN PATENT DOCUMENTS

JP 63-121290 8/1988

(Continued)

OTHER PUBLICATIONS

Office Action in corresponding JP Application No. 2002-316437 mailed Nov. 20, 2007 with English translation.

(Continued)

*Primary Examiner*—Leonard R Leo
(74) *Attorney, Agent, or Firm*—Harness, Dickey & Pierce, PLC

(57) ABSTRACT

There is provides a heat exchanger comprising: a plurality of tubes (110) stacked on each other; and a pair of header tanks (140), each header tank (140) having a flow section (151) in which fluid flows, extending in a direction of stack of the tubes (110), wherein both end sections (111) of the tubes (110) in the longitudinal direction are joined to the pair of header tanks (140), the flow section (151) of each header tank (140) and the inside of each tube (110) are communicated with each other, a tip position (a) of the tube end section (111) is arranged in an outside region of the flow section (151), and an inner wall width size (b) of the flow section (151) is smaller than a size (c) in the width direction of the header tank (140) at the tube end section (111).

13 Claims, 8 Drawing Sheets

U.S. PATENT DOCUMENTS

| | | | | | |
|---|---|---|---|---|---|
| 4,971,145 | A | * | 11/1990 | Lyon | 165/173 |
| 5,133,299 | A | * | 7/1992 | Rogan | 165/134.1 |
| 5,172,761 | A | * | 12/1992 | Lyon | 165/173 |
| 5,320,165 | A | | 6/1994 | Hughes | |
| 5,327,959 | A | * | 7/1994 | Saperstein et al. | 165/173 |
| 5,743,329 | A | | 4/1998 | Damsohn et al. | |
| 5,896,923 | A | | 4/1999 | Baba | |
| 6,155,340 | A | | 12/2000 | Folkedal et al. | |
| 6,216,776 | B1 | * | 4/2001 | Kobayashi et al. | 165/173 |
| 6,296,051 | B1 | * | 10/2001 | Sahnoun et al. | 165/173 |
| 6,564,863 | B1 | | 5/2003 | Martins | |
| 6,640,887 | B2 | | 11/2003 | Abell et al. | |
| 6,725,913 | B2 | * | 4/2004 | Memory et al. | 165/173 |
| 6,749,015 | B2 | * | 6/2004 | Moreau | 165/175 |
| 6,827,139 | B2 | * | 12/2004 | Kawakubo et al. | 165/173 |
| 2002/0020521 | A1 | * | 2/2002 | Hoshino et al. | 165/175 |
| 2002/0023734 | A1 | * | 2/2002 | Wagner | 165/173 |

FOREIGN PATENT DOCUMENTS

| | | |
|---|---|---|
| JP | A-3-46758 | 4/1991 |
| JP | 07-305992 | 11/1995 |
| JP | 10-232097 | 9/1998 |
| JP | 2000-081294 | 3/2000 |
| JP | 2001-133189 | 5/2001 |
| JP | 2002-543368 | 12/2002 |

OTHER PUBLICATIONS

Office Action from corresponding Japanese Application No. 2002-316437 dated Jun. 14, 2007 with English translation.

* cited by examiner

HEAT EXCHANGER

CROSS-REFERENCE TO RELATED APPLICATIONS

This application is a divisional of U.S. patent application Ser. No. 10/361,657 filed on Feb. 10, 2003 now U.S. Pat. No. 7,044,208. This application claims the benefit of JP 2002-041332 filed Feb. 19, 2002 and JP 2002-316437 filed Oct. 30, 2002. The disclosures of the above applications are incorporated herein by reference.

BACKGROUND

1. Technical Field of the Invention

The present invention relates to a heat exchanger. More particularly, the present invention relates to a heat exchanger preferably applied to, for example, a gas cooler or evaporator provided in a supercritical refrigerating cycle device.

2. Description of the Related Art

A conventional heat exchanger is disclosed, for example, in Japanese Unexamined Utility Model Publication No. 2-109185. This Japanese Unexamined Utility Model Publication No. 2-109185 relates to a heat exchanger in which a plurality of tubes 110 are connected between two header tanks 140. As shown in FIG. 16, this heat exchanger is composed as follows. The header tank 140 is composed of a tank section 150 and plate section 160. In the plate section 160, there is provided a tube insertion hole 161. In the tank section 150, there is provided an inclined face 155 with which a tube end section 111*a* comes into contact. In this structure, size $L_t$, by which the tube 110 is inserted into the tank section 150, is made to be smaller than size $L_s$ which is a size from the tube end section 111*a* to the tank ceiling section 153.

Due to the above structure, when the tube 110 is assembled to the header tank 140, the tube end section 111*a* comes into contact with the inclined face 155 of the tank section 150. Therefore, it is unnecessary to use an exclusive positioning jug. Further, it becomes unnecessary to conduct machining on the tube 110 to form a profile used for positioning. Further, when sizes $L_t$ and $L_s$ are determined so that an inequality $L_t<L_s$ can be satisfied, the resistance of flow in the header tank 140 can be decreased and the cross-sectional area of the tank section 150 can be reduced.

However, even if the above structure is adopted, the tube end section 111*a* still protrudes into the header tank 140 by size $L_t$ of insertion. This protruding tube end section 111*a* causes the resistance of flow when internal fluid flows in the header tank 140. Accordingly, a reduction in the cross-sectional area of the tank section 150 is naturally limited.

SUMMARY OF THE INVENTION

In view of the above problems, it is an object of the present invention to provide a heat exchanger capable of decreasing the resistance of flow in a header tank and further decreasing the size of the header tank.

In order to accomplish the above object, in an aspect of the present invention, there is provided a heat exchanger comprising: a plurality of tubes (110) stacked on each other; and a pair of header tanks (140), each header tank (140) having a flow section (151) in which fluid flows, extending in a direction of stack of the tubes (110), wherein both end sections (111) of the tubes (110) in the longitudinal direction are joined to the pair of header tanks (140), the flow section (151) of each header tank (140) and the inside of each tube (110) are communicated with each other, a tip position (a) of the tube end section (111) is arranged in an outside region of the flow section (151), and an inner wall width size (b) of the flow section (151) is smaller than a size (c) in the width direction of the header tank (140) at the tube end section (111).

Due to the above structure, no turbulence of flow of the fluid flowing in the flow section (151) of the header tank (140) is caused by the tube end section (111), and the resistance of flow can be decreased. Therefore, the size of the flow section (151) can be reduced corresponding to the decrease in the resistance of flow. Accordingly, it is possible to reduce the size of the header tank (140) compared with the size of the header tank (140) of the prior art disclosed in Japanese Unexamined Utility Model Publication No. 2-109185.

According to the reduction in the size of the flow section (151), a surface area inside the flow section (151) is decreased, and an intensity of a rupture force (tensile force) given to the cross section of the wall section (154) of the flow section (151) by the internal pressure of fluid can be decreased. As a result, the proof pressure strength can be enhanced.

In another aspect of the present invention, the header tank (140) is composed of a tank section (150) in which the flow section (150) is formed and a plate section (160) to which the tube end section (111) is joined, and a communicating section (152) is provided between the flow section (151) and the tube end section (111) so that both can be communicated with each other through the communicating section (152).

In the case where the header tank (140) is formed being integrated into one body, it is necessary to conduct a complicated profile machining so that the header tank (140) can have both the joining section of the tube (110) and the communicating section (152). On the other hand, according to the present invention, when the tank section (150) and the plate section (160) are formed differently from each other, a simple profile machining may be conducted on the tank section (150) and the plate section (160). Therefore, the entire machining can be easily performed.

The present invention may be more fully understood from the description of preferred embodiments of the invention, as set forth below, together with the accompanying drawings.

DESCRIPTION OF THE PREFERRED EMBODIMENTS

First Embodiment

Figure 1:
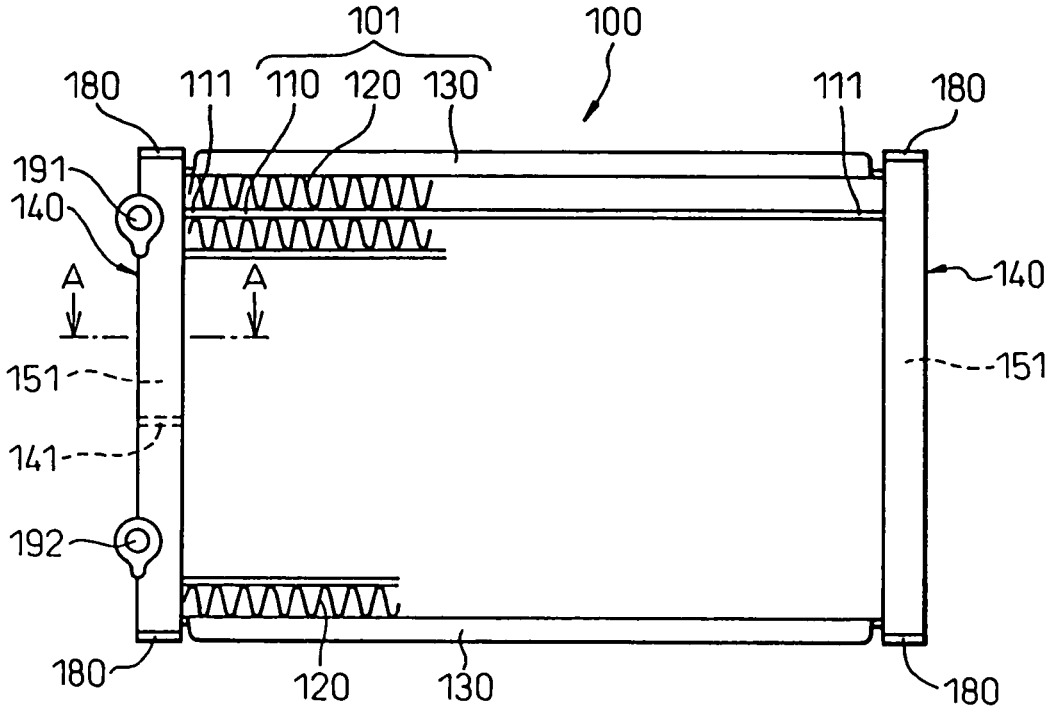
FIG. 1 is a front view showing an overall arrangement of a gas cooler of the present invention.

A first embodiment of the present invention is shown in FIGS. 1 to 4. In this case, the heat exchanger of the present invention is applied to a gas cooler 100 provided in a supercritical refrigerating cycle in which $CO_2$ is used as a refrigerant (fluid). First of all, referring to FIG. 1, an overall arrangement of the gas cooler will be explained below.

In this connection, the supercritical refrigerating cycle is defined as a refrigerating cycle in which ethylene, ethane or nitrogen oxide besides $CO_2$ is used as a refrigerant.

The gas cooler 100 is composed of a core section 101 and header tanks 140 arranged on the right and left. Members composing the above components, which will be explained below, are made of aluminum or aluminum alloy and assembled by means of engagement, calking or fixation by a jig and further soldered into one body with solder previously provided in necessary portions on the surfaces of the members.

In the core section 101, a plurality of tubes 110, in which a refrigerant flows, and a plurality of fins 120, which are formed into a wave-shape, are alternately laminated on each other, and the side plates 130, which are members for reinforcement, the cross sections of which are formed into a U-shape and are open outward, are arranged outside the outermost fins 120 arranged in an upper and a lower portion. These members are soldered into one body.

In the right and the left portion of this core section 101 in the drawing, that is, in the tube end sections 111 of the plurality of tubes 110 in the longitudinal direction, there are provided a pair of header tanks 140 extending in the direction of lamination of the tubes 110.

End sections 111 of each tube are joined and soldered to the header tanks 140 so that the flow section 151 provided in each header tank 140 and the inside of each tube 110 can be communicated with each other. A joining structure of the header tank 140 to the tube 110 is a characteristic of the present invention, the detail of which will be explained later.

End caps 180 are soldered to the end sections of both header tanks 140 in the longitudinal direction, so that the opening sections formed by the flow section 151 can be closed.

In the left header tank 140 in the drawing, the separator 141 is soldered which partitions the flow section 151 in the header tank 140. The inlet joint 191 is soldered to the upper side of the left header tank 140 with respect to the separator 141, and the outlet joint 192 is soldered to the lower side of the left header tank 140 with respect to the separator 141. These joints are communicated with the flow section 151 in the left header tank 140.

Figure 2:
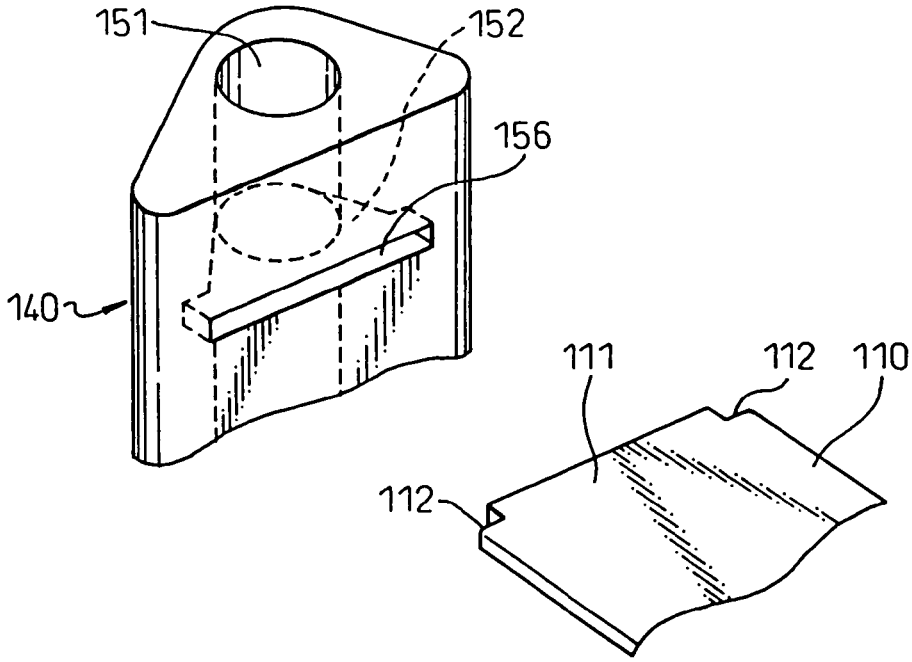
FIG. 2 is an exploded perspective view showing a header tank and tube of a first embodiment of the present invention.
Figure 3:
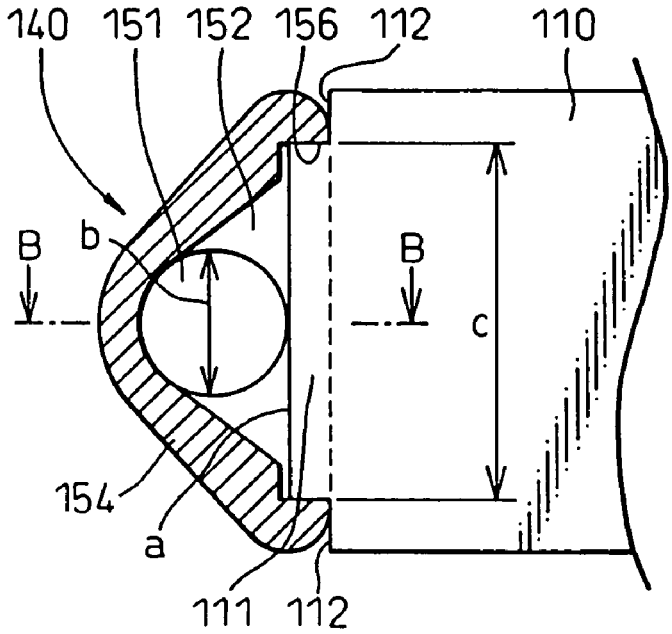
FIG. 3 is a sectional view taken on line A-A in FIG. 1.
Figure 4:
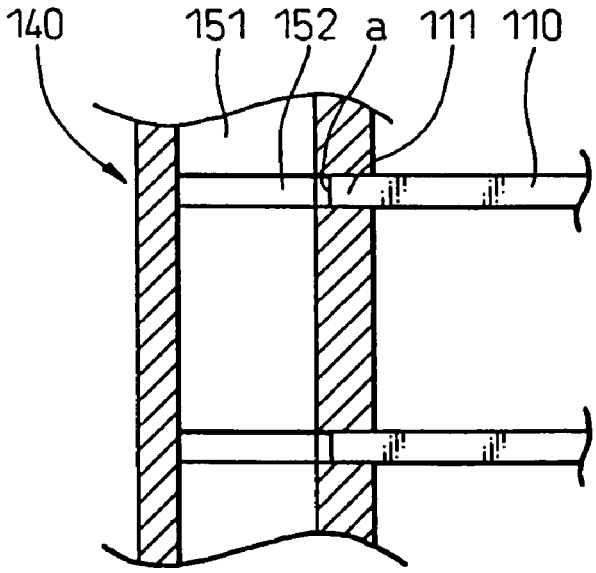
FIG. 4 is a sectional view taken on line B-B in FIG. 3.

Next, referring to FIGS. 2 to 4, a primary portion of the present invention will be explained in detail. In this case, a cross section of the header tank 140 is triangular. In the header tank 140, a flow section 151, in which a refrigerant flows, is arranged in the longitudinal direction. The header tank 140 having this flow section 151 can be easily formed by means of extrusion, and a cross section of the flow section 151 is formed to be circular.

On a face of the header tank 140 on the tube 110 side, there are provided tube insertion holes 156, into which the tube end sections 111 are inserted, corresponding to positions of the tube end sections 111. Further, there are provided communicating sections 152 for smoothly connecting the tube insertion holes 156 with the flow section 151 so that the tube insertion holes 156 can be communicated with the flow section 151.

A cross section of each tube 110 is flat. In the same manner as that of the header tank 140, the tube 110 is formed by means of extrusion. Inside the tube 110, there are provided a plurality of flat passages (not shown) arranged in the longitudinal direction. At the end section of the tube end 111 in the longitudinal direction, there is provided a cutout portion 112.

The tube end section 111 is inserted into and soldered to the tube insertion hole 156 of the header tank 140. At this time, the tip position "a" of the tube end section 111 is arranged in a region outside the flow section 151. That is, when the cutout portion 112 provided in the tube 110 comes into contact with a face of the header tank 140 on the tube side, the tip position "a" of the tube end section 111 is restricted, so that it can not get into the flow section 151.

As the tube end section 111 does not get into the region of the flow section 151, the inner wall width "b" of the flow section 151 of the header tank 140 is smaller than the width "c" of the header tank 140 of the tube end section 111 to be joined.

In the gas cooler 100 composed as described above, the inlet joint 191 shown in FIG. 1 is connected with the discharge side of a compressor not shown in the drawing, and the outlet joint 192 is connected with an expansion valve not shown in the drawing. A refrigerant of high temperature and pressure discharged from the compressor flows into the left header tank 140 from the inlet joint 191 and flows in a group of tubes 110 arranged on the upper side of the separator 141. Then, the refrigerant flows into the right header tank 140 and makes a U-turn and flows in the group of tubes 110 arranged on the lower side of the separator 141. Then, the refrigerant flows out from the outlet joint 192. At this time, heat exchange is conducted between the refrigerant and the outside air in the core section 101.

In the structure of the present invention, the tube end sections 111 do not get into the region of the flow section 151 of the header tank 140. Therefore, a flow of the refrigerant flowing in the flow section 151 is not disturbed by the tube end sections 111, so that the flowing resistance can be reduced. Accordingly, a size of the flow section 151 can be reduced corresponding to the reduction in flowing resistance. As a result, a size of the header tank 140 can be further reduced compared with the header tank of the prior art disclosed in Japanese Unexamined Utility Model Publication No. 2-109185.

According to the reduction in the size of the flow section 151, a surface area inside the flow section 151 is decreased. Therefore, a rupture force (tensile force) given to the cross section of the wall section 154 (shown in FIG. 3) of the flow section 151 by internal pressure of the refrigerant can be decreased. Therefore, the proof pressure strength can be enhanced.

As the cross section of the flow section 151 is circular, internal pressure given by the refrigerant in the flow section 151 can be dispersed, and the occurrence of stress concentration can be prevented. Therefore, the proof pressure strength of the header tank 140 can be further enhanced.

Second Embodiment

Figure 5:
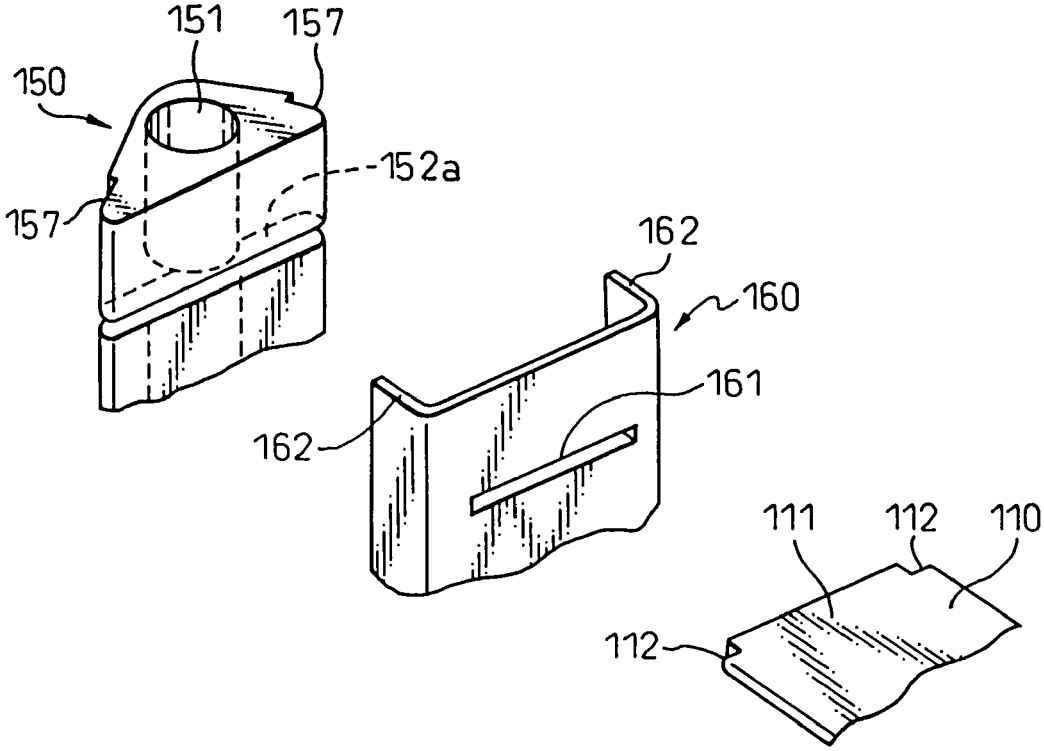
FIG. 5 is an exploded perspective view showing a tank section, plate section and tube of a second embodiment of the present invention.
Figure 6:
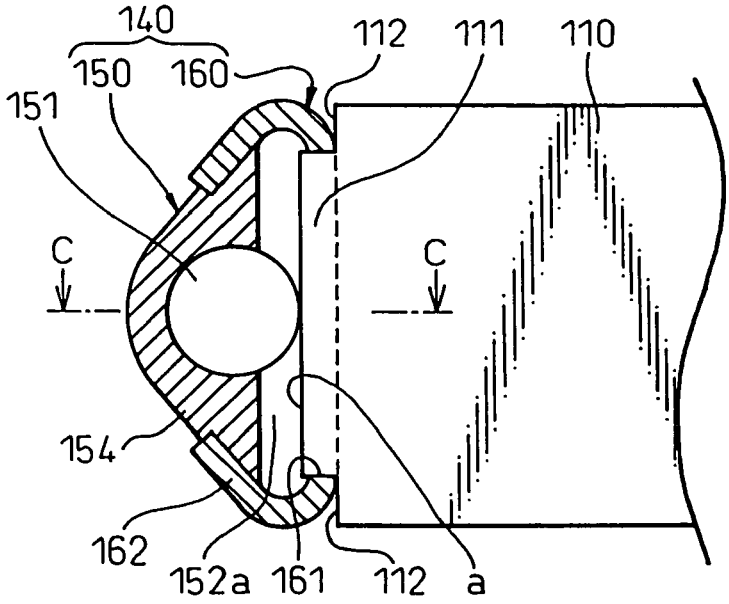
FIG. 6 is a sectional view taken on line A-A in FIG. 1 of the second embodiment.
Figure 7:
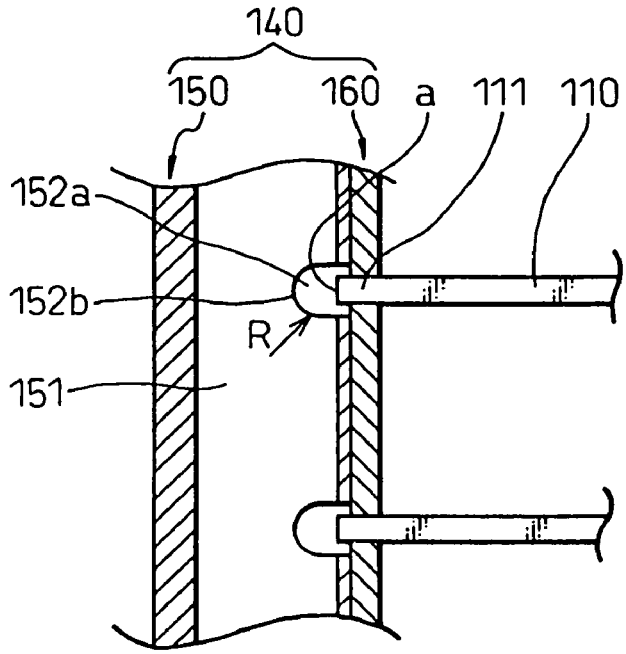
FIG. 7 is a sectional view taken on line C-C in FIG. 6.

A second embodiment of the present invention is shown in FIG. 5 to 7. The points of the second embodiment different from the first embodiment are described as follows. The header tank 140 is composed of a tank section 150 and a plate section 160, so that the tube insertion holes and the flow section can be easily formed.

The tank section 150 is composed on the basis of the header tank 140 explained in the first embodiment. The tank section 150 includes a recessed calking section 157, which is formed at the end in the width direction, to which the plate section 160 is calked. Further, at the position corresponding to the tube end section 111, the recess section 152*a*, which is a communicating section, is arranged.

This recess portion 152*a* is formed by means of cutting conducted in such a manner that a portion of the tank section 150 is cut from the plate section side toward the opposite plate section side so that a portion of the flow section 151 can be cut, and this recess portion 152*a* penetrates in the width direction of the tank section 150. The bottom portion 152*b* of the recess section 152*a* is formed into an arcuate profile (R).

In this connection, the width of the recess section 152*a* is larger than the thickness of the short side of the flat section of the tube 110.

On the other hand, the plate section 160 is formed by means of press forming into a C-shape having the gripping sections 162 at both side end sections. At a position on the plate section 160 corresponding to the tube end section 111, the tube insertion hole 161 is formed.

In this connection, the specification of the tube 110 is the same as that of the first embodiment.

After the plate section 160 has been made to come into contact with the tank section 150, the tank section 150 is calked with the gripping sections 162 of the plate section 160 so as to form the header tank 140. Then, the tube end section 111 is inserted into the tube insertion hole 161, and these members are soldered to each other into one body.

In this second embodiment, insertion of the tube end section 111 is also restricted by the cutout portion 113 provided in the tube 110. Therefore, the tip position "a" of the tube 110 does not enter into a region of the flow section 151 of the tank section 140.

In the case of the first embodiment in which the header tank 140 is formed being integrated into one body, it is necessary to conduct machining to form a complicated profile (the tube insertion hole 156 and the communicating section 152 of the first embodiment) in which the joining section and the communicating section of the tube 110 are combined with each other. On the other hand, in this second embodiment, the tank section 150 and the plate section 160 are formed differently from each other. Therefore, the tank section 150 and the plate section 160, which respectively have a simple profile, can be easily formed by machining. Accordingly, the entire machining can be easily performed.

In the plate section 160, the tube insertion hole 161, which is a joining section of the tube 110, can be formed by press forming. In the tank section 150, the recess section 152*a*, which is a communicating section, may be formed in such a manner that a portion of the tank section 150 is cut from the plate section side toward the opposite plate section side so that a portion of the flow section 151 can be cut. In this way, machining can be easily performed by means of drilling or boring.

The recess section (communicating section) 152*a* is provided so that it penetrates the tank section 150 in the width direction, and the width of the recess section 152*a* is made to be larger than the thickness of the tube 110. Therefore, the entire opening of the tube end section 111 is connected with the recess section 152*a* while leaving a gap. Therefore, the resistance of flow of a refrigerant can be decreased at the tube end section 111.

The bottom section 152*b* of the communicating section of the recess section 152*a* is formed into an arcuate profile (R). Therefore, the occurrence of concentration of stress caused by internal pressure of the refrigerant can be prevented and the proof pressure strength can be enhanced.

Figure 8:
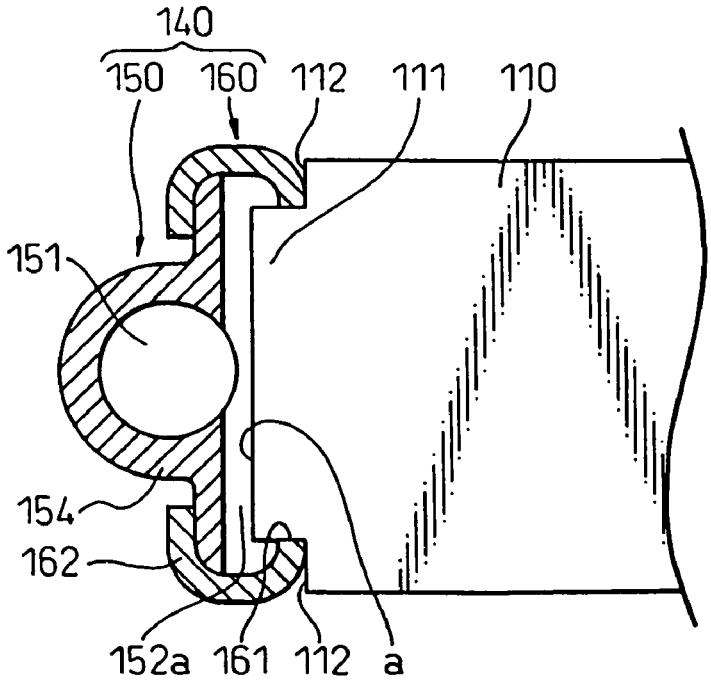
FIG. 8 is a sectional view showing a header tank and tube of a variation of the second embodiment.

In this connection, when the thickness of the wall section 154 of the tank section 150 is reduced to the necessary minimum along the flow section 151 as shown in FIG. 8 in which a variation of the second embodiment is shown, the weight of the heat exchanger can be further reduced.

Third Embodiment

Figure 9:
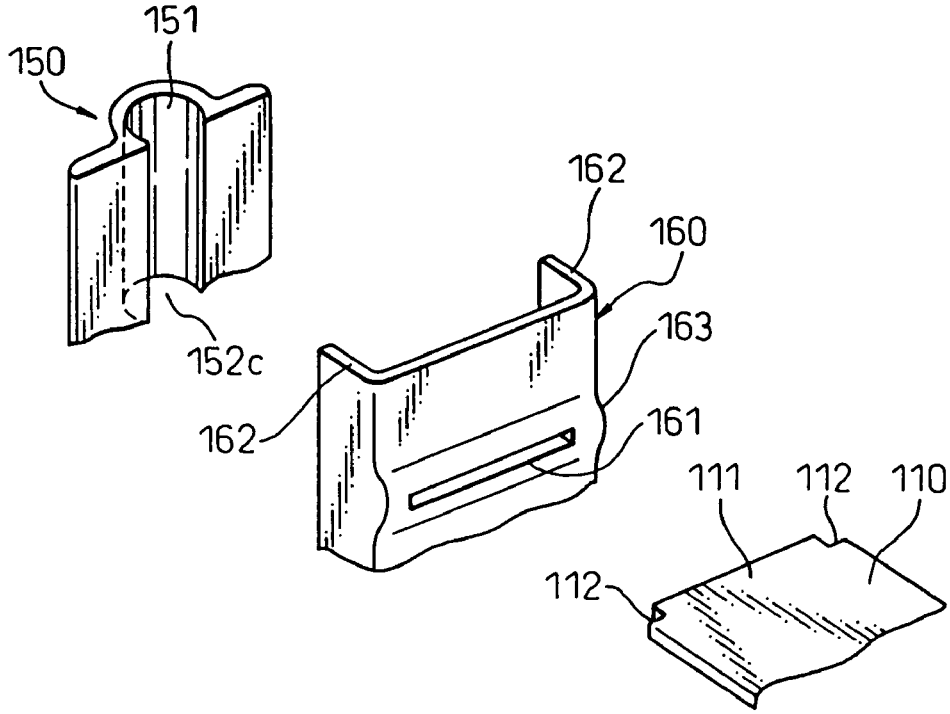
FIG. 9 is an exploded perspective view showing a tank section, plate section and tube of a third embodiment of the present invention.
Figure 10:
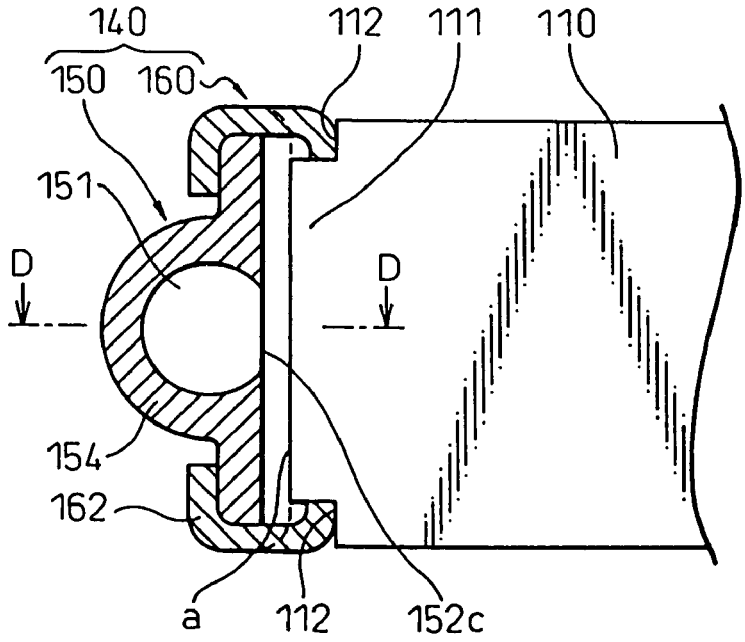
FIG. 10 is a sectional view taken on line A-A in FIG. 1 in the third embodiment.
Figure 11:
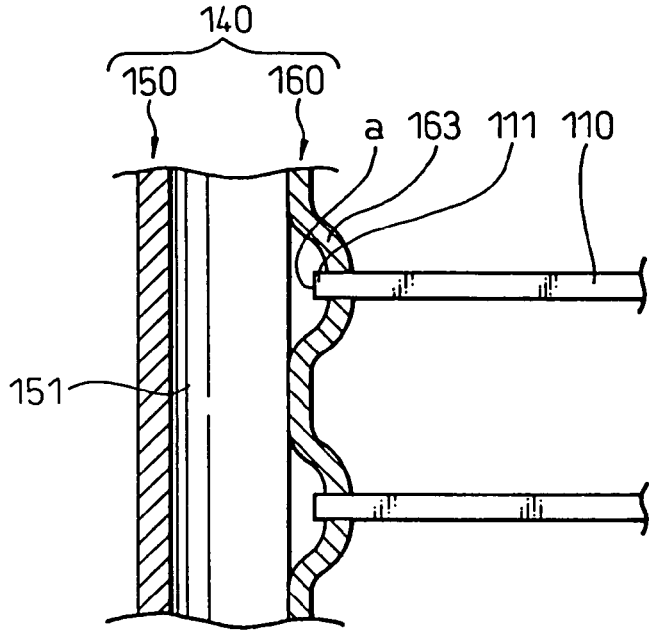
FIG. 11 is a sectional view taken on line D-D in FIG. 10.

A third embodiment of the present invention is shown in FIGS. 9 to 11. Points of the third embodiment different from the second embodiment are described as follows. In the third embodiment, there is provided an opening section 152*c* from which the flow section 151 of the tank section 150 is open onto the plate section 160 side, and there is also provided an expanding section 163, which expands onto the opposite side to the tank section, in a portion of the plate section 160 to which the tube end section 111 is joined.

In this connection, the opening section 152*c* is formed in the longitudinal direction of the tank section 150. The expanding section 163 of the plate section 160 is formed by press forming together with the tube insertion hole 161.

Due to the above structure, by the expanding section 163 formed in the opening section 152*c* of the tank section 150 and the plate section 160, a portion corresponding to the communicating section explained in the second embodiment, to be specific, a portion corresponding to the recess section 152*a* can be formed. Therefore, it becomes unnecessary to machine the tank section 150 so as to form the communicating section of the recess section 152*a*, which reduces the manufacturing cost of the heat exchanger.

According to the above structure, it becomes possible to arrange the tube end section 111 inside the expanding section 163. Therefore, the flow resistance of the refrigerant at the tube end section 111 can be decreased.

Further, when the tube end section 111 is soldered, the plate section 160 and the tube 110 can be stably joined to each other. Accordingly, there is no possibility that solder enters the tube 110 and the tube 110 is clogged.

Fourth Embodiment

Figure 12:
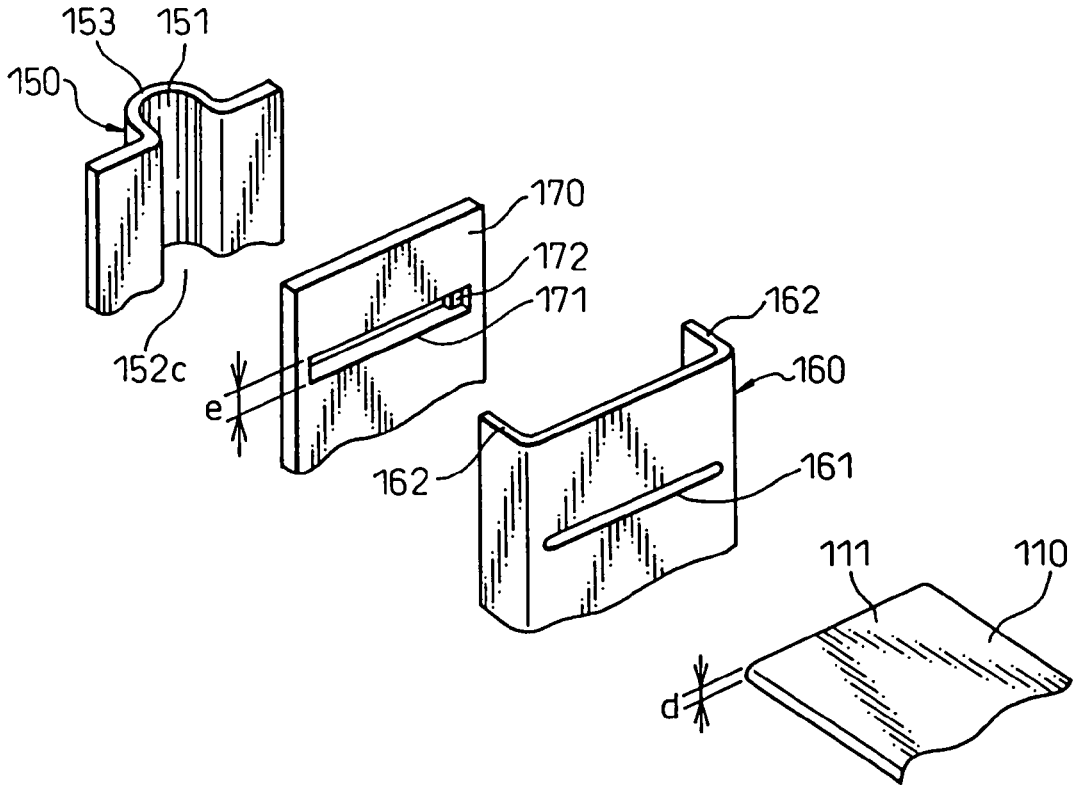
FIG. 12 is an exploded perspective view showing a tank section, intermediate plate section, plate section and tube of a fourth embodiment of the present invention.
Figure 13:
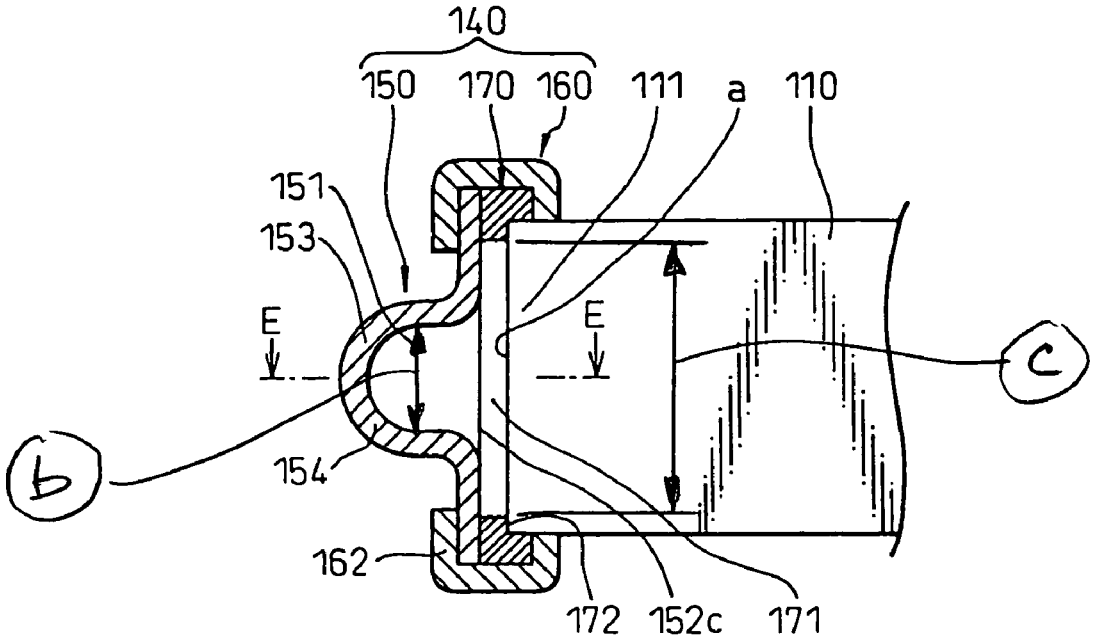
FIG. 13 is a sectional view taken on line A-A in FIG. 1 of the fourth embodiment.
Figure 14:
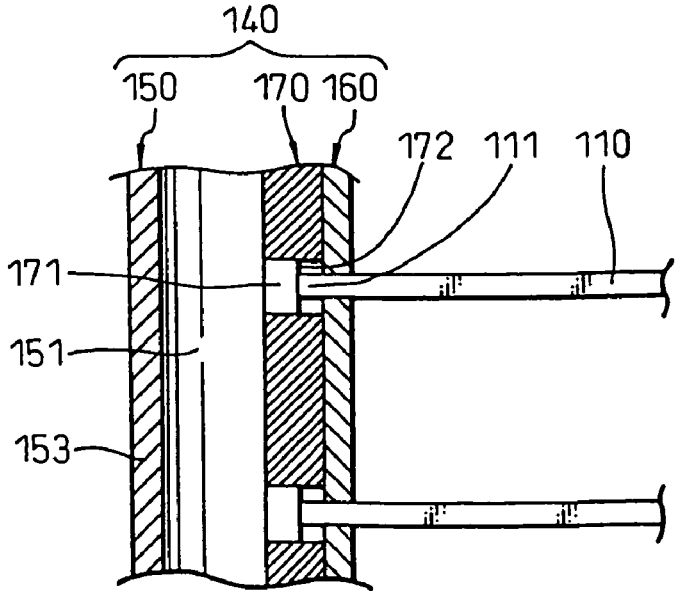
FIG. 14 is a sectional view taken on line E-E in FIG. 13.

A fourth embodiment of the present invention is shown in FIGS. 12 to 14. The points of the fourth embodiment different from the third embodiment are described below. Between the tank section 150 and the plate section 160, there is provided an intermediate plate section 170, and a communicating section is formed by the plate hole 171, which is provided in the intermediate plate section 170, and the opening section 152*c* of the tank section 150. Further, this structure is characterized in a portion where solder necessarily for soldering is provided.

In this structure, the tank section 150 is formed from a flat plate, on the surface of which solder has been previously clad, by press forming so that a cross section of the flow section 151 can be formed into a U-shape. In this connection, the ceiling section 153 on the side opposite to the plate section is formed into an arc. Therefore, internal pressure caused by fluid flowing in the flow section 151 can be uniformly dispersed and the occurrence of stress concentration can be prevented. Accordingly, the proof pressure strength of the header tank 140 can be more enhanced. In this connection, solder is provided on the tank section 150 on the plate 160 side.

The plate section 160 has no expanding section 163 which is provided in the third embodiment, that is, the plate section 160 is flat and provided with the tube insertion hole 161. In this connection, on both sides of the plate section 160, which is explained in the second embodiment, formed by press forming of a plate member, solder is previously clad.

The intermediate plate section 170 is a rectangular flat plate member arranged along a face of the tank section 150 on which the opening section 152*c* is provided. At the position corresponding to the tube end section 111, there is provided a plate hole 171. At the end section of the plate hole 171 in the longitudinal direction, there is provided a step portion 172 which is a position restricting section for restricting a position of the tube end section 111 in the middle of the wall thickness. The plate hole 171 is formed larger than the cross section of the tube end section 111. Specifically, the width "e" of the plate hole 171 is larger than the thickness (size of the short side of the flat section) "d" of the tube 110. In this case, the width "e" of the plate hole 171 is set to be twice as large as the thickness "d" of the tube 110. This intermediate plate section 170 is different from the tank section 150 and the plate section 160, that is, this intermediate plate section 170 is made of a bare plate member, on the surface of which no solder is provided.

In this connection, in this embodiment, a position of the tube end section 111 is restricted by the step position regulating section 172 of the intermediate plate section 170. Therefore, the tube 110 has no cutout portion 112 explained in the first to the third embodiment. No solder is provided on the surface of the tube 110, which is explained in the first embodiment, formed by means of extrusion.

The tank section 150, intermediate plate section 170, plate section 160 and tube 110 are assembled to each other as shown in FIGS. 13 and 14. The tip position "a" of the tube end section 111 is restricted by the step portion 172 of the plate hole 171 of the intermediate plate section 170 to be in a region outside the flow section 151, and the tube end section 111 is arranged in a space in the plate hole 171. A communicating section is formed by the opening section 152 of the tank section 150 and the plate hole 171 of the intermediate plate section 170. The members 150, 170, 160, 110 are integrally soldered into one body by solder provided in the tank section 150 and the plate section 160.

Due to the foregoing, the expanding section 163 described in the third embodiment can be composed of the plate hole 171 of the intermediate plate section 170. Therefore, machining can be easily performed.

In this embodiment, the step portion position restricting section 172 is provided in the intermediate plate section 170. Therefore, a specific tube profile (cutout section) and an exclusive jig, which are used for positioning the tube end section 111, become unnecessary. Further, almost all the region of the opening section of the tube end section 111 is connected with the flow section 151. Therefore, the resistance of flow of the refrigerant at the tube end section 111 can be reduced.

As the plate hole 171 of the intermediate plate section 170 is larger than the cross section of the tube end section 111, it is possible to ensure a gap between the opening section of the tube end section 111 and the communicating section 152*c*, 171, and further the resistance of flow of the refrigerant can be reduced.

As the opening section 152*c* is formed in the tank section 150, it becomes possible to adopt the means of press forming. Therefore, the manufacturing cost can be decreased.

Further, as the intermediate plate section 170 is composed of a bare plate member, on the surface of which no solder is provided, when the members 150, 170, 160, 110 are integrally soldered into one body, it is possible to prevent solder from directly entering the tube 110 via the tube end section 111. Accordingly, there is no possibility that the tube 110 is clogged with solder.

Another Embodiment

Figure 15:
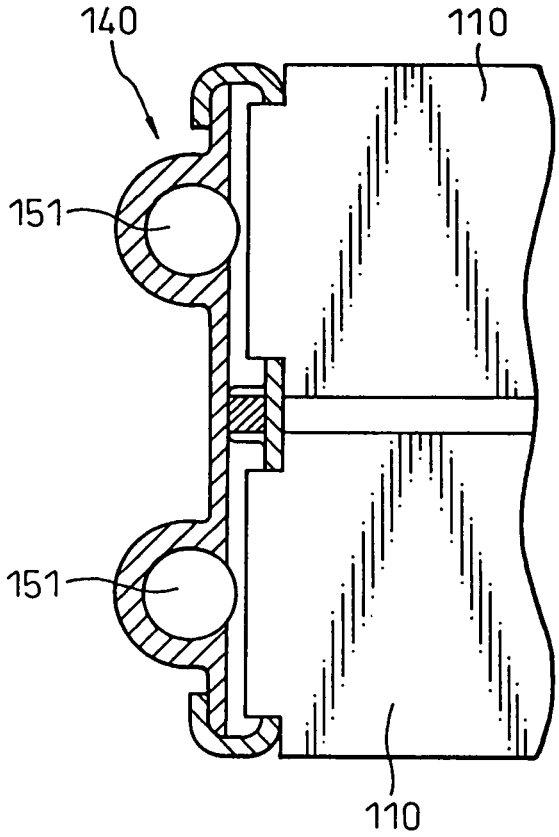
FIG. 15 is a sectional view showing a header tank and tube of another embodiment of the present invention.
Figure 16:
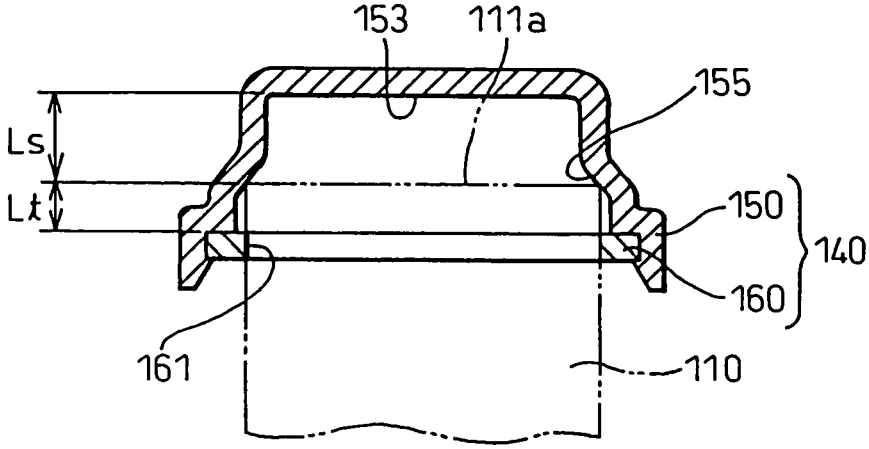
Fig.16 PRIOR ART
FIG. 16 is a sectional view showing a header tank and tube of the prior art.

In the first to the fourth embodiment described above, one row of the flow section 151 of the header tank 140 is provided in the width direction of the header tank 140. However, as shown in FIG. 15, a plurality of rows of the flow sections 151 may be provided together with the tubes 110.

Explanations are made above into a heat exchanger applied to the gas cooler 100 arranged in a supercritical refrigerating cycle device. However, it is possible to apply the heat exchanger to an evaporator in which a refrigerant is evaporated.

Further, the heat exchanger of the present invention can be applied not to only a system in which a refrigerant of high pressure is circulated, such as a supercritical refrigerating cycle device using $CO_2$ as a refrigerant, but also to a usual refrigerating cycle device or a vehicle engine.

While the invention has been described by reference to specific embodiments chosen for purposes of illustration, it should be apparent that numerous modification could be made thereto by those skilled in the art without departing from the basic concept and scope of the invention.

What is claimed is:

1. A heat exchanger comprising:

a plurality of tubes stacked on each other in a direction of stack of the tubes; and a pair of header tanks, each header tank having a flow section in which fluid flows, the flow section of each header tank extending continuously in the direction of stack of the tubes, each of the plurality of tubes extending in a longitudinal direction between the pair of header tanks; wherein both end sections of the tubes in the longitudinal direction are joined to the pair of header tanks, the flow section of each header tank and an inside of each tube communicate with each other, a tip position of the tube end section is arranged in an outside region of the flow section, a width of the flow section in a width direction generally perpendicular to both the longitudinal direction and the direction of stack of the tubes is smaller than a width in the width direction of the header tank at the tube end section over the entire length of the header tank, and the width of the flow section of the header tank in the width direction is smaller than a width in the width direction of the inside of the tube in direct communication with the flow section of the header tank;

the header tank is composed of a tank section in which the flow section is formed and a plate section to which the tube end section is joined, and a communicating section is provided between the flow section and the tube end section so that both can be communicated with each other through the communicating section;

a width of the communicating section in the width direction is larger than the largest width of the flow section of the header tank in the width direction; and an intermediate plate section is interposed between the tank section and the plate section, and the communicating section is composed of an opening section, in which the flow section is open on the plate section side and a plate hole arranged at a position corresponding to the tube end section in the intermediate plate section.

2. A heat exchanger according to claim 1, wherein the plate hole is provided with a position restricting section for restricting a position of the tube end section in the middle of the wall thickness of the intermediate plate section.

3. A heat exchanger according to claim 2, wherein the intermediate plate section is composed of a bare plate, on the surface of which no solder is provided.

4. A heat exchanger according to claim 1, wherein the plate hole is larger than a cross section of the tube end section.

5. A heat exchanger according to claim 1, wherein the flow section of each header tank extends continuously over an entire stacked length of the plurality of the tubes.

6. The heat exchanger according to claim 1, wherein the entire width of the flow section of the header tank in the width direction is smaller than the width in the width direction of the inside of the tube.

7. The heat exchanger according to claim 1, wherein a width section of the flow section of the header tank in the width direction immediately adjacent the tip position of the tube end section is smaller than the width in the width direction of the inside of the tube.

8. A heat exchanger comprising:

a plurality of tubes stacked on each other; and a pair of header tanks, each header tank having only a single flow section in which fluid flows, the single flow section of each header tank extending in a direction of stack of the tubes, wherein both end sections of the tubes in the longitudinal direction are joined to the pair of header tanks, the single flow section of each header tank and the inside of each tube communicate with each other, a tip position of the tube end section is arranged in an outside region of the single flow section, and an inner wall width size of the single flow section is smaller than an inner wall width size of the header tank at the tube end section;

the header tank is composed of a tank section in which the single flow section is formed and a plate section to which the tube end section is joined, and a communicating section is provided between the single flow section and the tube end section so that both can be communicated with each other through the communicating section;

an inner wall width size of the communicating section is larger than the largest inner wall width size of the single flow section; and an intermediate plate section is interposed between the tank section and the plate section, and the communicating section is composed of an opening section, in which the single flow section is open on the plate section side and a plate hole arranged at a position corresponding to the tube end section in the intermediate plate section.

9. The heat exchanger according to claim 8, wherein the entire inner wall width size of the single flow section of the header tank is smaller than an inner wall width size of the tube.

10. The heat exchanger according to claim 8, wherein the inner wall width size of the single flow section of the header tank immediately adjacent the tip position of the tube end section is smaller than an inner wall width size of the tube.

11. A heat exchanger comprising:

a plurality of tubes stacked on each other in a direction of stack of the tubes; and a pair of header tanks, each header tank having a flow section in which fluid flows, the flow section of each header tank extending continuously in the direction of stack of the tubes, each of the plurality of tubes extending in a longitudinal direction between the pair of header tanks wherein both end sections of the tubes in the longitudinal direction are joined to the pair of header tanks, the flow section of each header tank and an inside of each tube communicate with each other, a tip position of the tube end section is arranged in an outside region of the flow section, a width of the flow section in a width direction generally perpendicular to both the longitudinal direction and the direction of stack of the tubes is smaller than a width in the width direction of the header tank at the tube end section over the entire length of the header tank, and the width of the flow section in the width direction is smaller than a width in the width direction of an entire end section of the tube through which fluid flows;

the header tank is composed of a tank section in which the flow section is formed and a plate section to which the tube end section is joined, and a communicating section is provided between the flow section and the tube end section so that both can be communicated with each other through the communicating section;

a width of the communicating section in the width direction is larger than the largest width of the flow section of the header tank in the width direction; and an intermediate plate section is interposed between the tank section and the plate section, and the communicating section is composed of an opening section, in which the flow section is open on the plate section side and a plate hole arranged at a position corresponding to the tube end section in the intermediate plate section.

12. The heat exchanger according to claim 11, wherein the entire width of the flow section of the header tank in the width direction is smaller than the width in the width direction of the inside of the tube.

13. The heat exchanger according to claim 11, wherein a width section of the flow section of the header tank in the width direction immediately adjacent the tip position of the tube end section is smaller than the width in the width direction of the inside of the tube.

* * * * *